US006374414B1

(12) United States Patent
Collier

(10) Patent No.: US 6,374,414 B1
(45) Date of Patent: Apr. 23, 2002

(54) ADJUSTMENT SYSTEM FOR A GARMENT OR OTHER ARTICLE

(75) Inventor: John J. Collier, Boulder, CO (US)

(73) Assignee: Salomon S.A., Annecy (FR)

( * ) Notice: Subject to any disclaimer, the term of this patent is extended or adjusted under 35 U.S.C. 154(b) by 0 days.

(21) Appl. No.: 09/671,574

(22) Filed: Sep. 27, 2000

(51) Int. Cl.[7] ..... A41D 27/12
(52) U.S. Cl. ..... 2/69; 2/908
(58) Field of Search ..... 2/80, 83, 69, 79, 2/108, 93–94, 85, 220, 115, 221, 105–106, 69.5, 457–458, 2.11, 2.14–2.15, 59–60, 123, 127, 236, 129, 159, 16, 162, 901, 908, 917, 920, 336, 337, 232, 237

(56) References Cited

U.S. PATENT DOCUMENTS

| | | | | | |
|---|---|---|---|---|---|
| 752,769 | A | * | 2/1904 | Graichen | 2/162 |
| 1,296,430 | A | * | 3/1919 | Riley | 2/162 |
| 3,089,149 | A | * | 5/1963 | Kelleam | 2/221 |
| 3,110,903 | A | * | 11/1963 | Burchard | 2/221 |
| 4,601,066 | A | * | 7/1986 | Campbell | 2/70 |
| 4,868,927 | A | * | 9/1989 | Bourdeau et al. | 2/161.1 |
| 5,504,944 | A | * | 4/1996 | Bromer et al. | 2/269 |
| 5,555,561 | A | * | 9/1996 | Plachta et al. | 2/455 |

* cited by examiner

*Primary Examiner*—John J. Calvert
*Assistant Examiner*—Tejash Patel
(74) *Attorney, Agent, or Firm*—Oblon, Spivak, McClelland, Maier & Neustadt, P.C.

(57) ABSTRACT

An adjustment system having a configuration capable of adjusting a length of a section of a garment. The adjustment system advantageously includes at least one section of material upon which the adjustment system is incorporated. The section of material includes an attachment portion, a first portion, a second portion, and a middle portion or flap. The flap is positioned between the first portion and the second portion and the attachment portion is positioned generally adjacent to the second portion and the flap. The adjustment system includes an extensible member that extends between the first portion and the second portion, and thereby forms the flap by generally biasing the first portion and the second portion towards one another and bulging the middle portion. The adjustment system further includes an adjustment device configured to adjustably connect the flap to the attachment section, thereby providing the wearer with the ability to adjust the length of the material by defining the extend to which the flap is pulled toward the attachment section. In an alternative embodiment, the adjustment system includes a first section of material, a second section of material, an extensible member connecting the first section of material to the second section of material, a first mating member attached to the first section of material, and a second mating member attached to the second section of material, where the second mating member is configured to mate with the first mating member.

37 Claims, 5 Drawing Sheets

ADJUSTMENT SYSTEM FOR A GARMENT OR OTHER ARTICLE

BACKGROUND OF THE INVENTION

1. Field of the Invention

The present invention relates generally to an adjustment system that can be used for garments or other articles. More specifically, the adjustment system provides a configuration capable of adjusting a length of a section of a garment.

2. Discussion of the Background

In various articles of clothing, it is advantageous to be able to adjust the dimensions of the article of clothing to fit snugly on the wearer. For example, outdoor sportswear such as raincoats or ski apparel greatly benefit from adjustable cuffs or pant leg openings that provide an adjustable snug fit on the wearer and thereby prevent water or ice from entering the garment and contacting the wearer. In some articles of clothing it is aesthetically beneficial to have the ability to adjust the fit on the wearer, for example, to slim the waist of a coat. Other items such as adjustable baseball caps, belts, wristwatch bands, or other similar items require a device that can allow the wearer to adjust the fit on the wearer in order for the item to remain in position on the wearer.

FIG. 1 depicts a related art device that is designed to allow the wearer to adjust the fit of an article of clothing on the wearer. The device in FIG. 1 is a cuff 110 for a sportswear article. The cuff 110 includes an elastic band 112 that is incorporated in the cuff, and hook and loop type mating fasteners 114 and 116 which are separate from the elastic band. A wearer can adjust the fit of the cuff by connecting the hook and loop type mating fasteners. The elastic band 112 is configured to only be in tension when the fasteners 114 and 116 are connected. One disadvantage of the device depicted in FIG. 1 is that the cuff does not provide any tightness of fit when the hook and loop fasteners 114 and 116 are disconnected. An additional disadvantage is that the device does not have a configuration that tends to automatically form a flap of material when the wearer grasps the fastener 114 and pulls fastener 114 towards fastener 116. Consequently, the wearer must force the material between the fasteners 114 and 116 into the shape of a flap 118 in order to properly join the fasteners in a neat manner.

SUMMARY OF THE INVENTION

An object of the present invention is to provide an adjustment system that can be used for garments or other articles. More specifically, an object of the present invention is to provide an adjustment system that includes a configuration capable of quickly and easily adjusting a length of a section of a garment and that overcomes the disadvantages of related art devices discussed above. The adjustment system can provide the ability, for example, to adjust the length of a section of the garment to make the garment have an adjustable fit for a wearer or to prevent water, snow, dirt, or other debris from entering an interior of the garment by allowing the wearer to tighten the fit of the garment. The adjustment system of the present invention advantageously provides an extensible member with at least one elastic part that can be configured to provide permanent tension even when the adjustment system is in an open position in order to ensure that the garment also fits closely to the body of the wearer to prevent debris from entering the interior of the garment.

The adjustment system of the present invention can be incorporated into a number of garments or other articles. For example, the adjustment system is particularly well suited for use in annular portions of garments, such as in a collar portion of a garment, a sleeve portion of a garment, a waist portion of a garment, a torso portion of a garment, a leg portion of a garment, an opening of a footwear article, an opening of a handwear article, an opening of a headwear article, and a band. The adjustment system advantageously provides a configuration capable of adjusting a length of a section of a garment. Therefore, the use of the adjustment system in an annular portion of a garment is particularly advantageous in that it provides the ability, for example, to adjust the length of a section of the garment to make the garment have an adjustable fit for a wearer or to prevent water, snow, dirt, or other debris from entering an interior of the garment by allowing the wearer to tighten the fit of the garment. The adjustment system of the present invention can also be incorporated into garments or articles having other configurations where it is advantageous to adjust a length of a section of the garment or article for any reason.

The adjustment system advantageously includes at least one section of material upon which the adjustment system is incorporated. The section of material includes an attachment portion, a first portion, a second portion, and a middle portion or flap. The flap is positioned between the first portion and the second portion and the attachment portion is positioned generally adjacent to the second portion and the flap. The adjustment system includes an extensible member with at least one elastic part that extends between the first portion and the second portion, and thereby forms the flap by generally biasing the first portion and the second portion towards one another and bulging the middle portion. The adjustment system further includes an adjustment device, such as a hook and loop type fastener, configured to adjustably connect the flap to the attachment section, thereby providing the wearer with the ability to adjust the length of the material by defining the extend to which the flap is pulled toward the attachment section. The adjustment device can be formed using hook and loop type fasteners, magnetic fasteners, snap fasteners, a strap and a buckle, a pair of mating buckles, or a member with repositionable adhesive material and a receiving member.

The adjustment system of the present invention advantageously provides a structure that requires less stitching than other systems. In other systems, elastic is placed on the inside of the garment in order to prevent exposure of the elastic to the elements (rain, etc.), but in order to avoid the skin of the wearer and piles in the garment from being caught in the elastic, the elastic must be closely connected to the garment by many traversals of stitching. These stitchings make the garment non-waterproof, since the such stitchings cannot be waterproofed by additional sealing straps, such as the sealing straps usually fixed by heat on the stitchings on breathable textiles such as GORE-TEX®. These sealing straps cannot be glued on the elastic. The adjustment system of the present invention uses less stitching and much of the stitching is on the textile so they can made easily waterproof by additional sealing straps. By reducing the amount of stitching used in the adjustment system, the adjustment system of the present invention is less expensive than other systems since the sealing straps needed to waterproof such stitching is very expensive and difficult to fix on the garment.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
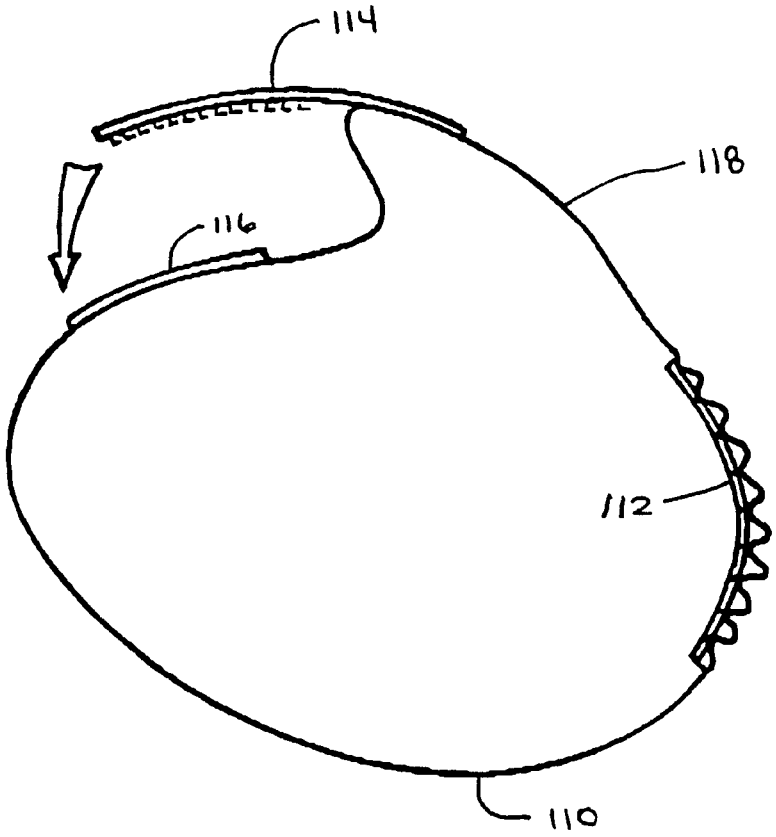
FIG 1 (Related Art)
FIG. 1 is a side view of a related art cuff for a sportswear article.
Figure 2:
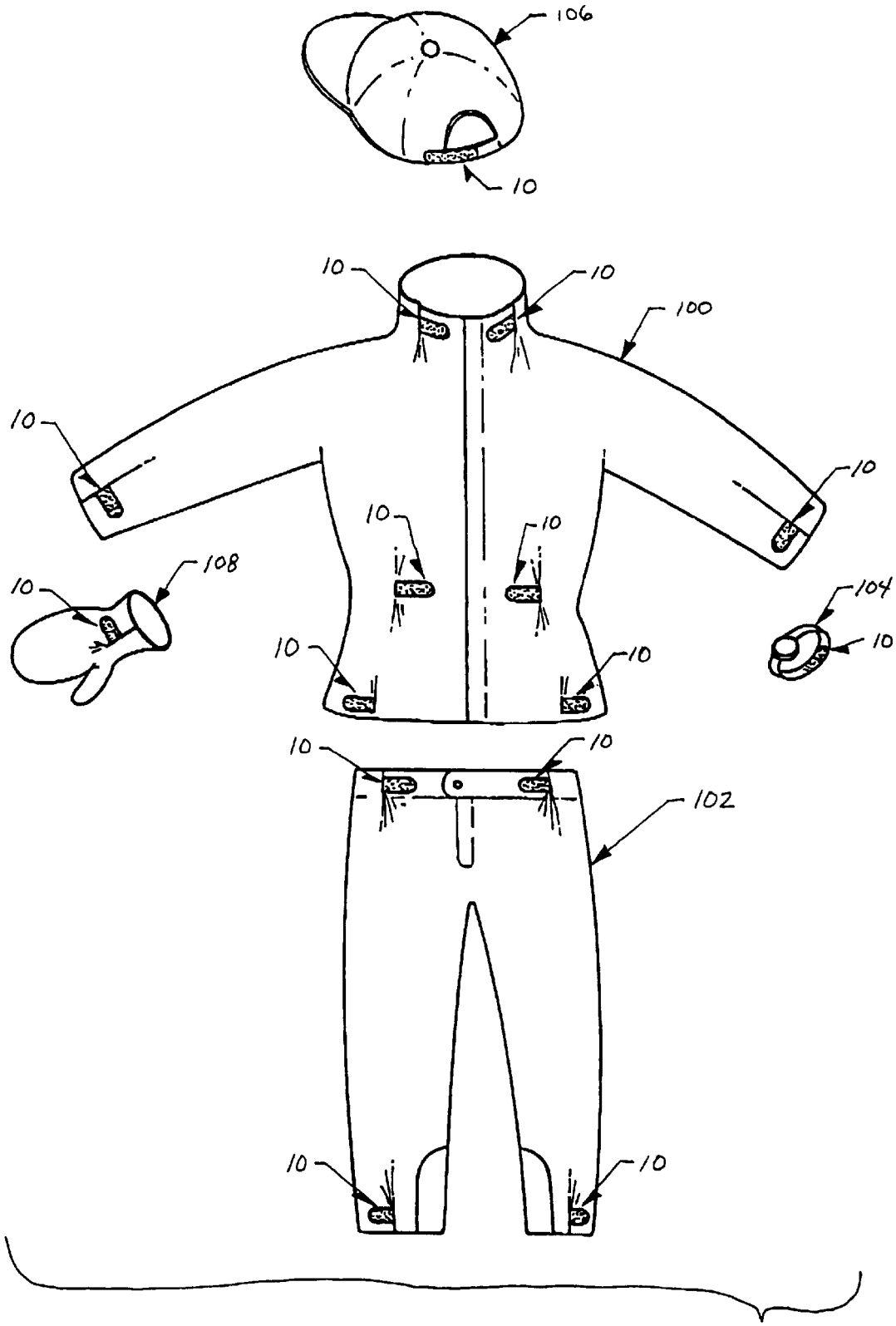
FIG. 2 depicts an adjustment system according to the present invention incorporated into various garments or articles.

Referring now to the drawings, where like reference numerals identify the same or corresponding parts throughout the several views, FIGS. 2 though 7 set forth various embodiments of an adjustment system according to the present invention.

FIG. 2 depicts various uses for an adjustment system 10 according to the present invention. The adjustment system of the present invention provides the ability, for example, to adjust the length of a section of a garment to make the garment have an adjustable fit for a wearer or to prevent water, snow, dirt, or other debris from entering an interior of the garment by allowing the wearer to tighten the fit of the garment. A particularly advantageous use of the adjustment system is in outdoor sportswear, such as snow apparel where a wearer desires a garment that is relatively impermeable to snow and other environmental elements.

As depicted in FIG. 2, the adjustment system 10 of the present invention can be incorporated into a number of garments or other articles. For example, the adjustment system 10 is particularly well suited for use in annular portions of garments, such as in a collar portion of a garment, a sleeve portion of a garment specially in the wrist portion, a waist portion of a garment (pant waist, jacket waist, shirt waist, etc.), a torso portion of a garment, a leg portion of a garment (pant leg, shorts leg, etc.), an opening of a footwear article (shoe, boot, sock, etc.), an opening of a handwear article (glove, mitten, etc.), an opening of a headwear article (baseball cap, ski hat adjustment strap within any type of hat, etc.), and a band (belt, waist band for items such as backpacks, wristwatch band, other straps used for various purposes, etc.). FIG. 2 depicts the adjustment system 10 incorporated into the collar, sleeve, waist, and torso of a jacket 100. FIG. 2 depicts the adjustment system 10 incorporated into the waist and leg portion of a pair of pants 102. FIG. 2 depicts the adjustment system 10 incorporated into the band of a wristwatch 104. FIG. 2 depicts the adjustment system 10 incorporated into a baseball cap 106. And FIG. 2 depicts the adjustment system 10 incorporated into a glove 108.

The adjustment system 10 advantageously provides a configuration capable of adjusting a length of a section of a garment. Therefore, the use of the adjustment system 10 in an annular portion of a garment is particularly advantageous in that it provides the ability, for example, to adjust the length of a section of the garment to make the garment have an adjustable fit for a wearer or to prevent water, snow, dirt, or other debris from entering an interior of the garment by allowing the wearer to tighten the fit of the garment. The adjustment system 10 of the present invention can also be incorporated into garments or articles having other configurations where it is advantageous to adjust a length of a section of the garment or article for any reason.

Figure 3:
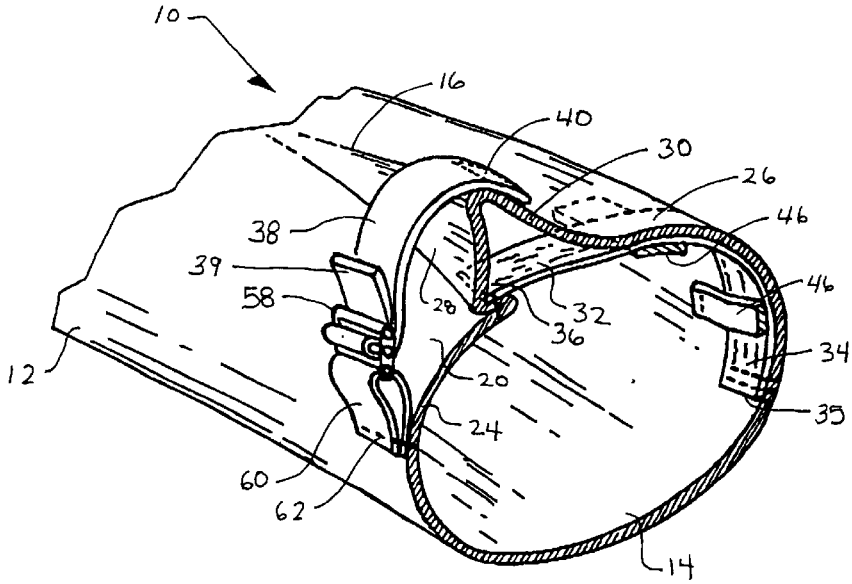
FIG. 3 is a perspective view with a cut of a first embodiment of an adjustment system according to the present invention.

FIG. 3 depicts a first embodiment of the adjustment system 10 of the present invention, which is depicted as being incorporated into a sleeve portion 12 specially in the wrist portion of a garment or article. The adjustment system 10 includes at least one section of material 20 upon which the adjustment system is incorporated, although the material 20 can be formed of several sections joined together and/or can be formed of one or more layers of material. The material 20 preferably includes the fabric used to construct the garment, however, generally speaking any type of material can be used and the material 20 can alternatively be made of a piece of material that is distinct from and/or integral to the fabric used to construct the garment.

The at least one section of material 20 includes an attachment portion 24, a first portion or position 26, a second portion or position 28, and a middle portion or flap 30. The flap 30 is positioned between the first portion 26 and the second portion 28. The attachment portion 24 is positioned generally adjacent to the second portion 28 and the flap 30. The adjustment system 10 includes an extensible member 32 that, generally speaking, has a portion 34 attached to the first portion 26 of material 20 and a portion 36 attached to the second portion 28 of the material 20. The extensible member 32 extends between the first portion 26 and the second portion 28, and thereby forms the flap 30 by generally biasing the first portion 26 and the second portion 28 towards one another and bulging the middle portion 30. The flap 30 is preferably configured toward the exterior side of the garment as compared to the extensible member 32 such that the bulge of material that defines the flap 30 is oriented to extend outward from an exterior surface of the garment incorporating the adjustment system 10.

The extensible member 32 can be constructed using any one or more of a variety of materials. The extensible member 32 is configured to provide a biasing force that moves the first and second portions 26 and 28 towards one another even absent external forces, such that the cuff fits snuggly around the user's arm even when the adjustment device is not engaged. In this configuration the perimeter of the annular section of the garment in which the adjustment system 10 is incorporated and the extensible member is constructed to have a global internal perimeter or length that is less than or equal to the perimeter of the body portion of the wearer upon which the garment is worn, in order to ensure that the extensible member is in tension. The extensible member 32 can be configured to provide a biasing force between the first portion 26 and the second portion 28 such that the first and second portions 26 and 28 are not moved towards one another or are slightly moved towards one another absent external forces, yet are moved towards one another when a user pulls on strap 38, thereby forming the flap 30. The extensible member 32 includes at least one elastic part or elastic return means. The extensible member 32 can be constructed such that the entire member is made of an elastic material, or it can be made partially of an elastic material and partially of an inelastic or non-extensible material. In an embodiment including both elastic material and non-extensible material, the elastic material and the non-extensible material can be arranged in either a series relationship or in a parallel relationship. An embodiment using both an elastic material and a non-extensible material can be constructed, for example, where the non-extensible material is configured to be in contact with the skin of the wearer so that the elastic material does not catch the piles.

Figure 4:
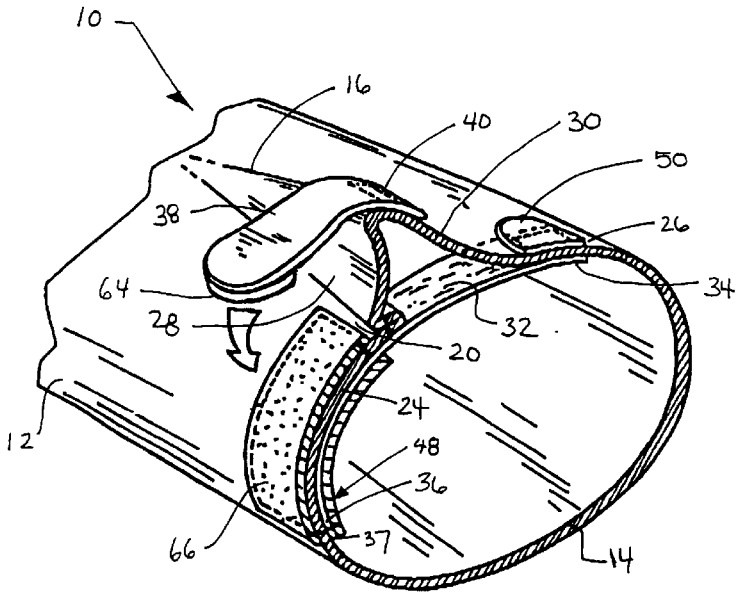
FIG. 4 is a perspective view cut of a second embodiment of an adjustment system according to the present invention.
Figure 5:
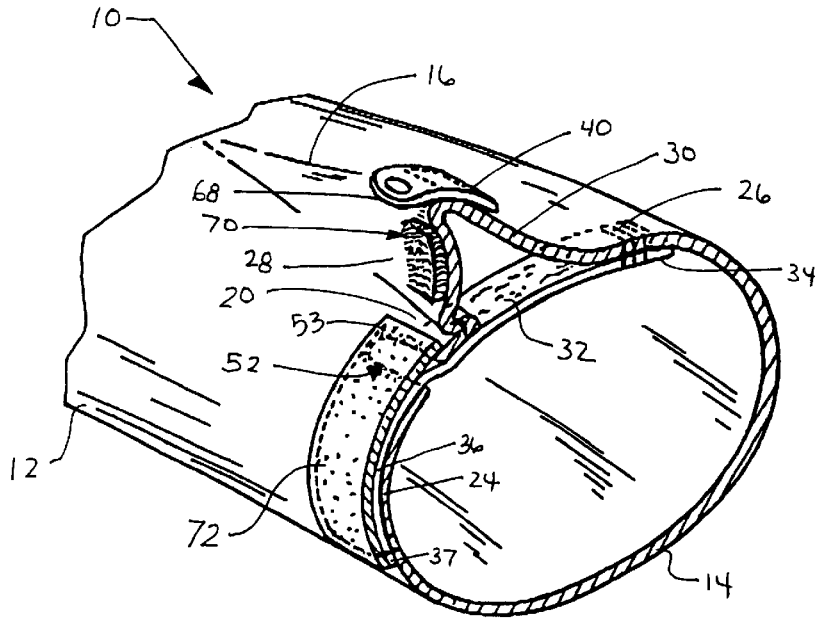
FIG. 5 is a perspective view cut of a third embodiment of an adjustment system according to the present invention.
Figure 6A:
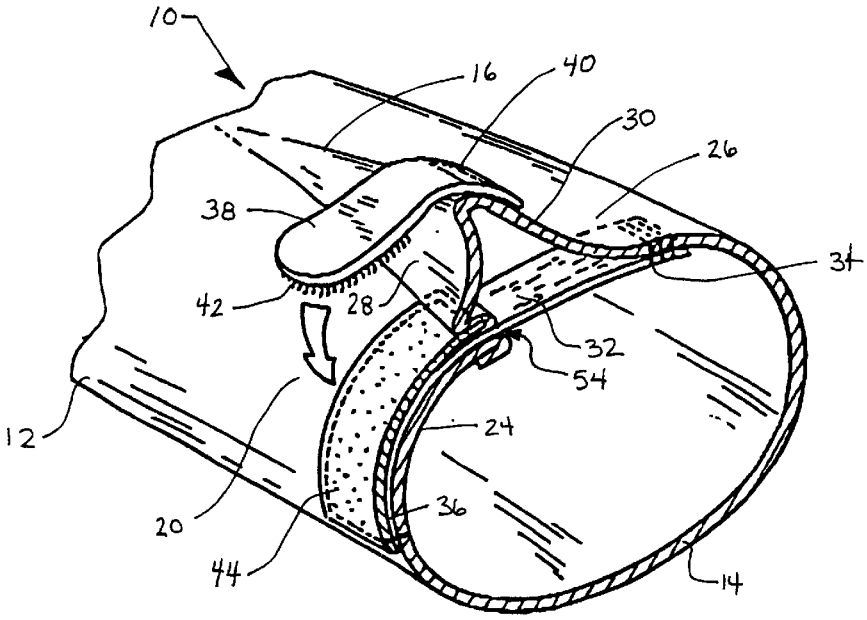
FIG. 6A is a perspective view cut of a fourth embodiment of an adjustment system according to the present invention.
Figure 6B:
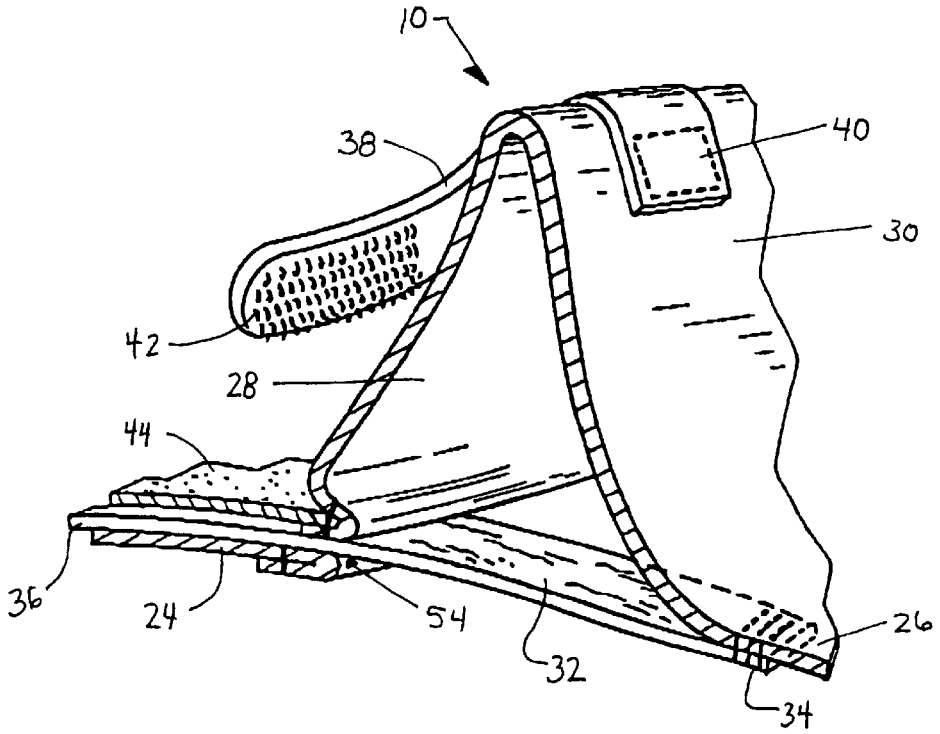
FIG. 6B is a partial, enlarged view cut of the fourth embodiment of the adjustment system depicted in FIG. 6A.

The adjustment system 10 further includes an adjustment device, such as a strap and a buckle as depicted in FIG. 3, a magnetic system as depicted in FIG. 4, or a hook and loop type fastener as depicted in FIGS. 5, 6A, and 6B. Of course, any adjustment device such as described in said figures can be used in combination with any embodiment construction such as described in any FIGS. 3, 4, 5, 6A, and 6B. In the first embodiment depicted in FIG. 3, the adjustment device includes a strap of material 38 having an end 40 attached to the flap 30. The strap 38 has a free end 39, and the attachment portion 24 of the material 20 has a loop portion 60 attached to the attachment portion 24 at end 62 and a buckle 58 connected to the loop portion 60. Note that the strap having a free end could alternatively be attached to the attachment portion 24, and the loop portion connected to the buckle could be attached to the flap 30. The free end 39 of the strap 38 is configured to be inserted and threaded through the buckle 58 in order to adjustably and detachably mate with one another. Once the strap 38 is mated with the buckle 58, the free end 39 of the strap 38 can be pulled in order to tighten the fit of the cuff about the wearer. The strap 38 is preferably relatively inelastic, however, alternative embodiments can include an elastic, or a combination elastic and inelastic or non-extensible strap.

In any embodiment such as described in the following figures, the adjustment device according to the present invention can be alternatively constructed to include (in place of or in addition to the strap and buckle fasteners) magnetic fasteners, snap fasteners, hook and loop fasteners, a pair of mating buckles, a member with repositionable adhesive material and a receiving member, or any combination thereof.

In the first embodiment depicted in FIG. 3, the adjustment system 10 of the present invention is depicted as being incorporated into a sleeve portion 12 of a garment or article. The sleeve portion 12 in this embodiment is generally depicted as a layer of fabric that is cut at the end 14 thereof. In the present invention, it is preferable to minimize the number of stitches used to fasten the adjustment system 10, since the use of stitches produce small holes in the layer of fabric that might allow water to penetrate through the layer of fabric. Moreover, fewer stitches may advantageously be used to decrease manufacturing costs. The loop portion 60 is attached to the attachment portion 24 at end 62 by stitches. Portion 36 of the extensible member 32 is stitched to the material 20 at a position where the attachment portion 24 and the second portion 28 join, with the layer of fabric being folded at that location in order to help define and form the base of the flap 30. If desired, the flap 30 is given a crease or pleat 16 by ironing the crease 16 when the garment is manufactured. Portion 34 of the extensible member 32 is stitched to the first portion 26. In the preferred embodiment, the portion 34 of the extensible member 32 is covered on the interior side of the garment by one or more guides 46 that guides and protects portion 34 of the extensible member 32. The guides 46 in this embodiment are parallel and are stitched along the edges thereof to the material 20 and/or the extensible member 32. Note that the guides can be constructed in the form of a sheath or inner liner, such that portion 34 of the extensible member 32 is sandwiched in between the sheath and the first portion 26. The portion 34 of the extensible member 32 is preferably stitched to the first portion 26 at the terminal end 35 of the portion 34 with the remainder of portion 34 being unattached. If the guides are in the form of a sheath, the sheath is stitched only along three edges thereof and is not stitched along the edge adjacent to the flap 30, thereby allowing the extensible member 32 to stretch along its entire length and to stretch out from and retract within the sheath. This configuration provides the adjustment system 10 with an elongated extensible member 32. Alternatively, the guides or the sheath are fastened to or connected to the extensible member 32. Moreover, the sheath or liner may extend along the entire length of the sleeve. Attachment methods other than or in addition to stitching can be used if so desired, as will be readily apparent to one of skill in the art.

Various methods can be used to weather-seal or waterproof the stitches in order to prevent moisture from entering the interior of the garment, as will be readily apparent to one of skill in the art. The adjustment system of the present invention advantageously provides a structure that requires less stitching than other systems. In other systems, elastic is placed on the inside of the garment in order to prevent exposure of the elastic to the elements (rain, etc.), but in order to avoid the skin of the wearer and piles in the garment from being caught in the elastic, the elastic must be closely connected to the garment by many traversals of stitching. These stitchings make the garment non-waterproof, since the such stitchings cannot be waterproofed by additional sealing straps, such as the sealing straps usually fixed by heat on the stitchings on breathable textiles such as GORE-TEX®. These sealing straps cannot be glued on the elastic. The adjustment system of the present invention uses less stitching and much of the stitching is on the textile so they can made easily waterproof by additional sealing straps. By reducing the amount of stitching used in the adjustment system, the adjustment system of the present invention is less expensive than other systems since the sealing straps needed to waterproof such stitching is very expensive and difficult to fix on the garment.

In the second embodiment depicted in FIG. 4, the adjustment system 10 of the present invention is depicted as being incorporated into a sleeve portion 12 of a garment or article. The adjustment system 10 of the second embodiment is similar in structure to the first embodiment, except as discussed below and depicted in the figures. The second embodiment includes a magnetic pad 64 attached to the end of strap 38 and a mating magnetic pad 66 attached to the attachment portion 24 by stitches extending around the perimeter of the magnetic pad 66. The mating magnetic pads 64 and 66 can be brought into contact with one another in order to adjustably and detachably mate with one another. An alternative embodiment includes replacing the mating magnetic pads 64 and 66 with a receiving pad and a mating repositionable adhesive pad or with a hook and loop type fastener.

In the second embodiment portion 36 of the extensible member 32 is stitched to the attachment portion 24. Portion 34 of the extensible member 32 is stitched to the first portion 26 without a guide or sheath-like structure. In the preferred embodiment, the stitches used to attach portion 34 of the extensible member 32 to the material 20 extend through a reinforcement piece of material 50 positioned on the outer surface of the material 20. In the second embodiment, portion 36 is covered by a sheath 48 (or alternatively one or more guides as described in the first embodiment) on the interior side of the garment that covers and protects portion 36 of the extensible member 32. The sheath 48 is stitched along the perimeter thereof to the material 20 and/or the extensible member 32. Portion 36 of the extensible member 32 is sandwiched in between the sheath 48 and the attachment portion 24. The portion 36 of the extensible member 32 is preferably stitched to the attachment portion 24 at the terminal end 37 of the portion 36 with the remainder of portion 36 being unattached and the sheath 48 being stitched only along three edges thereof and not being stitched along the edge adjacent to the flap 30, thereby allowing the extensible member 32 to stretch along its entire length and to stretch out from and retract within the sheath 48. This configuration provides the adjustment system 10 with an elongated extensible member 32.

In the third embodiment depicted in FIG. 5, the adjustment system 10 of the present invention is depicted as being incorporated into a sleeve portion 12 of a garment or article. The adjustment system 10 of the third embodiment is similar in structure to the first embodiment, except as discussed below and depicted in the figures. Specifically, the third embodiment includes a hook or loop portion 70 attached to the second portion 28 on the flap 30, and the attachment portion 24 of the material 20 has a hook or loop portion 72. The hook or loop portions 70 and 72 are configured to adjustably and detachably mate with one another. The hook or loop portion 72 is preferably configured to be elongated in shape such that the hook or loop portion 70 can be mated therewith at various positions along the length of the hook or loop portion 72, thereby allowing the user to adjust the tightness of the cuff. The strap 38 preferably includes a gripping pad 68 at the terminal end thereof to allow the wearer to attach and detach hook and loop portion 70 from hook and loop portion 72 the wearer having to insert a finger in the flap.

In the third embodiment the hook or loop portion 72 is attached to the attachment portion 24 by stitches extending around the perimeter of the hook or loop portion 72. Portion 36 of the extensible member 32 extends through a slit, cut or gap 52 formed in the attachment portion 24 underneath the hook or loop portion 72, such that the portion 36 extends between the hook or loop portion 72 and the attachment portion 24. In the third embodiment the hook or loop portion 72 and the attachment portion 24 act as a sheath-like structure to receive portion 36 on the exterior side of the garment and covers and protects portion 36 of the extensible member 32. The portion 36 of the extensible member 32 is preferably stitched to the attachment portion 24 at the terminal end 37 of the portion 36 with the remainder of portion 36 being unattached, thereby allowing the extensible member 32 to stretch along its entire length and to stretch out from and retract within the sheath-like structure through slit or gap 52. This configuration provides the adjustment system 10 with an elongated extensible member 32. The gap 52 has radial stitching 53 about the periphery thereof, which reinforces the gap 52 and prevents the extensible member 32 from enlarging the gap 52.

In the fourth embodiment depicted in FIGS. 6A and 6B, the adjustment system 10 of the present invention is depicted as being incorporated into a sleeve portion 12 of a garment or article. The adjustment system 10 of the fourth embodiment is similar in structure to the first embodiment, except as discussed below and depicted in the figures. A hook or loop portion 44 is attached to the attachment portion 24 by stitches extending around the perimeter of the hook or loop portion 44. A hook or loop portion 42 is attached at a terminal end of the strap 38. The hook and loop portions 42 and 44 being configured to adjustably and detachably connect to one another. Portion 36 of the extensible member 32 extends through a cut 54 formed in the material 20 at a position where the second portion 28 joins with the attachment portion 24, such that the portion 36 extends between the hook or loop portion 44 and the attachment portion 24. In the fourth embodiment the hook or loop portion 44 and the attachment portion 24 act as a sheath-like structure to receive portion 36 on the exterior side of the garment and covers and protects portion 36 of the extensible member 32. The portion 36 of the extensible member 32 is preferably stitched to the attachment portion 24 at the terminal end 37 of the portion 36 with the remainder of portion 36 being unattached, thereby allowing the extensible member 32 to stretch along its entire length and to stretch out from and retract within the sheath-like structure through the cut 54. This configuration provides the adjustment system 10 with an elongated extensible member 32.

Figure 7:
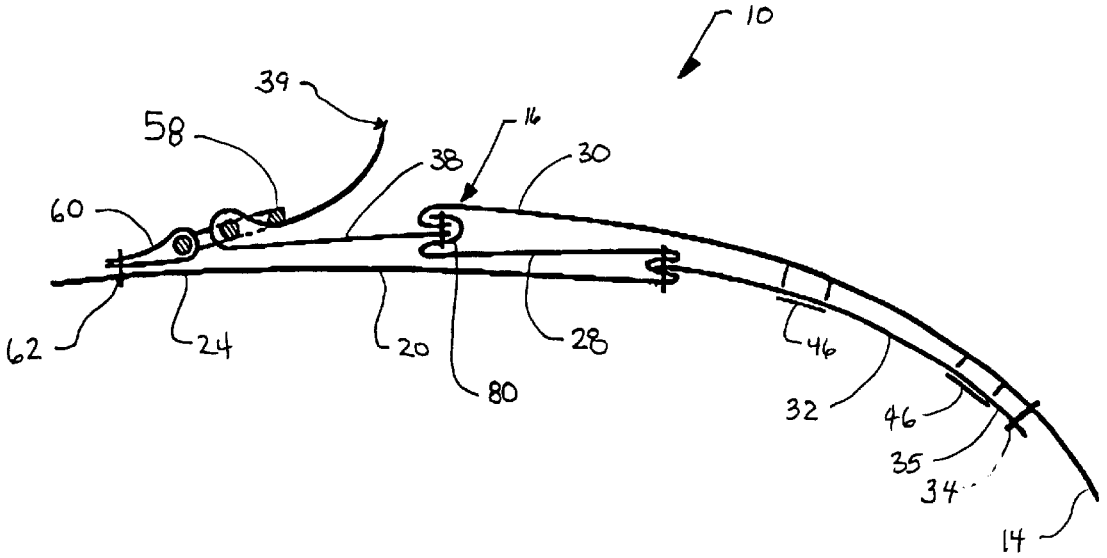
FIG. 7 is a side schematic view of a variation of the first embodiment of an adjustment system depicted in a fully closed position according to the present invention.

FIG. 7 depicts a side schematic view of a variation of the first embodiment (depicted in FIG. 3) of an adjustment system depicted in a fully closed position. In this variation of the first embodiment, the strap 38 of the adjustment system is attached in a different manner to the flap 30. In this variation the flap 30 is cut preferably all along the top in order to help construct a three dimensional flap by varying the perimeter of the garment's material from the beginning to the end of the flap, and the strap 38 is stitched to the cut at location 80 depicted in FIG. 7. The attachment of the extensible member 32 to the garment is different in this variation than in that depicted in FIG. 3. This construction helps the closing of the flap because the bottom of the flap is already pre-positioned by the stitching. This construction also provides a stronger attachment for the extensible member 32, since the extensible member 32 is sandwiched between two layers of the garment's material.

It should be noted that, in any of the above embodiments, if the flap of material is constructed to be large and the extensible member is constructed to be very extensible, the present invention does not need any guides (or sheaths). In this construction, the initial length of the extensible member should be constructed to be equal to the width of the bottom of the flap.

Additionally, it should be noted that portion 28 of the embodiments described above can be removed from the garment, thereby allowing the extensible member to be the sole or main connection between the portions 24 and 26.

Numerous variations of the present invention are possible in light of the above teachings. It is therefore to be understood that within the scope of the appended claims, the present invention can be practiced other than as specifically described herein.

What is new and desired to be secured by Letters Patent of the United States is:

1. An adjustment system comprising:

at least one section of material having an elastically extensible member attached to and extending between a first position and a second position of said at least one section of material thereby defining a flap of material between said first position and said second position, said at least one section of material having an attachment portion adjacent said flap of material; and an adjustment device extending between said flap of material and said attachment portion, said adjustment device being configured to adjustably mate said flap of material with said attachment portion.

2. The adjustment system according to claim 1, wherein said at least one section of material includes an annular portion of a garment.

3. The adjustment system according to claim 2, wherein said annular portion is selected from the group consisting essentially of a collar portion of a garment, a sleeve portion of a garment, a waist portion of a garment, a torso portion of a garment, a leg portion of a garment, an opening of a footwear article, an opening of a handwear article, an opening of a headwear article, and a band.

4. The adjustment system according to claim 1, wherein said adjustment device is selected from a group consisting essentially of hook and loop type fasteners, magnetic fasteners, snap fasteners, a strap and a buckle, a pair of mating buckles, and a member with repositionable adhesive material and a receiving member.

5. The adjustment system according to claim 1, wherein said flap of material is oriented to extend outward from an exterior surface of a garment incorporating said adjustment system.

6. The adjustment system according to claim 1, further comprising a guide attached to said at least one section of material, a first side of a portion of said extensible member being attached to a surface of said at least one section of material and a second side of said portion of said extensible member being adjacent said guide.

7. The adjustment system according to claim 6, wherein said portion of said extensible member is attached to said at least one section of material at a terminal end of said extensible member.

8. An adjustment system comprising:

at least one section of material having an extensible member attached to and extending between a first position and a second position of said at least one section of material thereby defining a flap of material between said first position and said second position, said at least one section of material having an attachment portion adjacent said flap of material; and an adjustment device extending between said flap of material and said attachment portion, said adjustment device being configured to adjustably mate said flap of material with said attachment portion, wherein said flap of material and said attachment portion are separated by a gap, said extensible member extending through said gap and being affixed between a portion of said adjustment device and said attachment portion of said at least one section of material.

9. The adjustment system according to claim 1, further comprising a reinforcement member attached to a first side of said at least one section of material, and wherein a portion of said extensible member is attached to a first side of said at least one section of material.

10. The adjustment system according to claim 1, wherein said adjustment device is configured to detachably mate said flap of material with said attachment portion.

11. An adjustment system comprising:

at least one section of material having an extensible member attached to and extending between a first position and a second position of said at least one section of material thereby defining a flap of material between said first position and said second position, said at least one section of material having an attachment portion adjacent said flap of material; and an adjustment device extending between said flap of material and said attachment portion, said adjustment device being configured to adjustably mate said flap of material with said attachment portion, wherein said extensible member has an elastic portion and a non-extensible portion.

12. The adjustment system according to claim 11, wherein said elastic portion and said non-extensible portion are in a series configuration.

13. The adjustment system according to claim 11, wherein said elastic portion and said non-extensible portion are in a parallel configuration.

14. An adjustment system comprising:

at least one section of material having an extensible member attached to and extending between a first position and a second position of said at least one section of material thereby defining a flap of material between said first position and said second position, said at least one section of material having an attachment portion adjacent said flap of material; and an adjustment device extending between said flap of material and said attachment portion, said adjustment device being configured to adjustably mate said flap of material with said attachment portion, wherein said adjustment system is constructed with stitching that is provided substantially only on said at least one section of material.

15. An adjustment system comprising:

at least one section of material having an extensible member attached to and extending between a first position and a second position of said at least one section of material thereby defining a flap of material between said first position and said second position, said at least one section of material having an attachment portion adjacent said flap of material; and an adjustment device extending between said flap of material and said attachment portion, said adjustment device being configured to adjustably mate said flap of material with said attachment portion, wherein said at least one section of material is an annular section of a garment, and wherein the at least one section of material and said extensible member have an internal perimeter that is at most equal to a perimeter of a body portion upon which the garment is worn.

16. An adjustment system comprising at least one section of material having an extensible member attached to and extending between a first position and a second position of said at least one section of material thereby defining a flap of material between said first position and said second position, said at least one section of material having an attachment portion adjacent said flap of material, wherein said flap of material is adjustably connected to said at least one section of material at a third position extending from said second position in a direction away from said first position.

17. The adjustment system according to claim 16, wherein said flap of material is detachably connected to said at least one section of material at said third position.

18. An adjustment system comprising:

at least one section of material having a first portion, a second portion spaced apart from said first portion, a middle portion located between said first portion and said second portion, and a third portion extending from said second portion in a direction away from said first portion;

an extensible member attached to said first portion and said second portion;

a first mating member attached to said middle portion; and a second mating member attached to said third portion, said second mating member being configured to mate with said first mating member.

19. The adjustment system according to claim 18, wherein said at least one section of material includes an annular portion of a garment.

20. The adjustment system according to claim 19, wherein said annular portion is selected from the group consisting essentially of a collar portion of a garment, a sleeve portion of a garment, a waist portion of a garment, a torso portion of a garment, a leg portion of a garment, an opening of a footwear article, an opening of a handwear article, an opening of a headwear article, and a band.

21. The adjustment system according to claim 18, wherein said first mating member and said second mating member are selected from a group consisting essentially of hook and loop type fasteners, magnetic fasteners, snap fasteners, a strap and a buckle, a pair of mating buckles, and a member with repositionable adhesive material and a receiving member.

22. The adjustment system according to claim 18, wherein said middle portion defines a flap of material oriented to extend outward from an exterior surface of a garment incorporating said adjustment system.

23. The adjustment system according to claim 18, further comprising a guide attached to said at least one section of material, a first side of a portion of said extensible member being attached to a surface of said at least one section of material and a second side of said portion of said extensible member being adjacent said guide.

24. The adjustment system according to claim 23, wherein said portion of said extensible member is attached to said at least one section of material at a terminal end of said extensible member.

25. The adjustment system according to claim 18, wherein said second portion and said third portion are separated by a gap, said extensible member extending through said gap and being affixed between a portion of said second mating member and said third portion of said at least one section of material.

26. The adjustment system according to claim 18, further comprising a reinforcement member attached to a first side of said at least one section of material, and wherein a portion of said extensible member is attached to a first side of said at least one section of material.

27. The adjustment system according to claim 18, wherein said second mating member and said first mating member are is configured to detachably mate.

28. An adjustment system comprising:

a first section of material;

a second section of material;

an elastically extensible member connecting said first section of material to said second section of material wherein a middle portion located between said first and second sections is defined by a flap of material;

a first mating member attached to said first section of material; and a second mating member attached to said second section of material, said second mating member being configured to mate with said first mating member.

29. The adjustment system according to claim 28, wherein said first section of material is connected to said second section of material.

30. The adjustment system according to claim 28, wherein said first section of material and said second section of material are formed from a single piece of material.

31. The adjustment system according to claim 28, wherein said first section of material and said second section of material define an annular portion of a garment.

32. The adjustment system according to claim 31, wherein said annular portion is selected from the group consisting essentially of a collar portion of a garment, a sleeve portion of a garment, a waist portion of a garment, a torso portion of a garment, a leg portion of a garment, an opening of a footwear article, an opening of a handwear article, an opening of a headwear article, and a band.

33. The adjustment system according to claim 28, wherein said first mating member and said second mating member are selected from a group consisting essentially of hook and loop type fasteners, magnetic fasteners, snap fasteners, a strap and a buckle, a pair of mating buckles, and a member with repositionable adhesive material and a receiving member.

34. The adjustment system according to claim 28, further comprising a guide attached to said first section of material, a first side of a portion of said extensible member being attached to a surface of said first section of material and a second side of said portion of said extensible member being adjacent to said guide.

35. The adjustment system according to claim 34, wherein said portion of said extensible member is attached to said first section of material at a terminal end of said extensible member.

36. The adjustment system according to claim 28, further comprising a reinforcement member attached to a first side of said first section of material, and wherein a portion of said extensible member is attached to a first side of said first section of material.

37. The adjustment system according to claim 28, wherein said second mating member and said first mating member are is configured to detachably mate.

* * * * *